US006227066B1

(12) United States Patent
Stachniak

(10) Patent No.: US 6,227,066 B1
(45) Date of Patent: May 8, 2001

(54) JOYSTICK CENTERING DEVICE SUPPORTING MULTIPLE COMPOUND TORQUE PROFILES

(75) Inventor: Darryl S. Stachniak, Chicago, IL (US)

(73) Assignee: MPC Products Corporation, Niles, IL (US)

( * ) Notice: Subject to any disclaimer, the term of this patent is extended or adjusted under 35 U.S.C. 154(b) by 0 days.

(21) Appl. No.: 09/360,911

(22) Filed: Jul. 26, 1999

(51) Int. Cl.[7] ..... G05G 9/047
(52) U.S. Cl. ..... 74/471 XY; 267/150
(58) Field of Search ..... 74/471 XY; 200/6 A; 267/150; 273/148 B; 345/161

(56) References Cited

U.S. PATENT DOCUMENTS

| | | | | |
|---|---|---|---|---|
| 2,383,554 | | 8/1945 | Krickler | 73/133 |
| 2,896,034 | * | 7/1959 | Nolden et al. | 200/16 A |
| 3,308,675 | * | 3/1967 | Jonsson | 74/471 R |
| 3,434,342 | | 3/1969 | Kazmarek | 73/133 |
| 3,927,285 | * | 12/1975 | Frost et al. | 200/6 A |
| 4,124,787 | | 11/1978 | Aamoth et al. | 200/6 |
| 4,148,014 | | 4/1979 | Burson | 340/711 |
| 4,375,631 | * | 3/1983 | Goldberg | 338/128 |
| 4,394,548 | | 7/1983 | Dola | 200/6 |
| 4,439,648 | | 3/1984 | Reiner et al. | 200/6 |
| 4,479,038 | | 10/1984 | Marhold et al. | 200/6 |
| 4,769,517 | | 9/1988 | Swinney | 200/6 |
| 5,056,787 | | 10/1991 | Mitsuyoshi | 273/148 |
| 5,436,640 | | 7/1995 | Reeves | 345/161 |
| 5,543,592 | | 8/1996 | Gaultier et al. | 200/6 |
| 5,598,090 | | 1/1997 | Baker et al. | 322/3 |
| 5,659,334 | | 8/1997 | Yaniger et al. | 345/156 |
| 5,706,027 | | 1/1998 | Hilton et al. | 345/156 |
| 5,724,068 | | 3/1998 | Sanchez et al. | 345/161 |
| 5,829,745 | | 11/1998 | Houle | 273/148 |

* cited by examiner

*Primary Examiner*—Allan D. Herrmann
(74) *Attorney, Agent, or Firm*—Laff, Whitesel & Saret, Ltd.

(57) ABSTRACT

A self centering, angularly displacable joystick allowing multiple compound torque profiles is provided. The self centering joystick includes a first mount and a base. The first mount located a fixed distance away from the base. The joystick extends from a restoring plate having an upper surface and a multi-faceted lower surface pivotally mounted to said first mount to partially rotate about a first axis. A linearly displaceable force plate having a substantially flat upper surface is disposed between said base and said multi-faceted surface, and a spring is provide between the base and the force plate, the spring biasing the force plate against the multi-faceted surface to provide a centering force there against. The multifaceted surface includes a center position facet oriented such that the centering force applied by the force plate is evenly distributed on each side of the first axis when said center position facet is aligned parallel with the upper surface of the force plate.

21 Claims, 4 Drawing Sheets

JOYSTICK CENTERING DEVICE SUPPORTING MULTIPLE COMPOUND TORQUE PROFILES

BACKGROUND OF THE INVENTION

The present invention relates to a self-centering "joystick" input device capable of supporting multiple compound torque profiles for returning the joystick to the center position. Joystick input devices are well known in the art, and have been employed in a wide range of applications, from aircraft control to video game inputs. Joysticks may be provided to supply directional input information related to a single rotational axis, or to multiple axes. More sophisticated joystick instruments may provide magnitude data as well.

In operation, an operator will manually displace the joystick relative to one or more of its rotational axes in order to issue directional commands to other equipment. Sensors within the joystick will sense the angular displacement of the joystick and develop input signals accordingly, which may be transmitted to the equipment to be controlled. The sensors and the signals they produce may operate electronically, hydraulically, or otherwise.

In many applications it is desirable that the joystick return to a center or neutral position after it has been released by the operator. Many joysticks are designed to be displaced about two perpendicular axes, so that directional information may be detected through 360°. Thus, in order to return the joystick to a center position on both axes, many designs have required two or more springs to provide a centering force relative to each axis. Some designs, for example that disclosed in U.S. Pat. No. 4,124,787 require two springs per axis. A problem with multiple spring designs is their complexity and higher cost. Also, most multiple spring designs include a significant amount of backlash around the center position. Backlash around the center position allows the joystick to be displaced by a small amount without developing an adequate restoring force to return the joystick to center. Thus, prior art instruments often include a slight wobble around the center position that can lead to inaccurate input measurements. The backlash problem is especially troublesome in applications where a high degree of accuracy and sensitivity is required.

A number of single spring designs have been developed in order to simplify the design of self-centering joysticks and reduce backlash. U.S. Pat. Nos. 4,479,038 and 5,724,068, for example, each employ a single spring to bias a thrust plate, or force plate, against a restoring member which is attached to the joystick itself. These designs prove simpler, and improve backlash around the center position, however, they are limited to providing a uniform restoring torque that is substantially equal in all directions.

In some applications it is desirable that the restoring torque for returning the joystick to the center position be greater in some directions than it is in others. Further, it may also be desired that the torque profile have a step such that the restoring torque is significantly increased if the joystick is displaced beyond a certain amount. Prior art joystick designs include no provisions for such multiple compound force profiles.

SUMMARY OF THE INVENTION

In light of the background given above, a primary object of the present invention is to provide a self centering joystick that may be angularly displaced relative to at least one axis and automatically and accurately returned to a center position.

A further object of the invention is to provide a self-centering joystick having compound torque profiles wherein a restoring torque for returning the joystick to the center position varies significantly depending on the angular displacement of the joystick.

Yet another object of the present invention is to provide a self-centering joystick having multiple torque profiles, compound or otherwise, provided by a single biasing spring.

These objects, as well as others that will become apparent upon reading the detailed description of the preferred embodiment are accomplished by the Self-Centering Joystick as herein disclosed.

The present invention provides a centering device for returning an angularly displaceable joystick to a center position, and retaining the joystick in the center position until it is acted upon by an external force. The centering device provides multiple compound torque profiles for restoring the joystick to the centered position. The compound force profiles are such that as the joystick is angularly displaced, the magnitude of the restoring torque is dependent on the direction and angular distance that the joystick is displaced. Furthermore, the multiple compound torque profiles are provided by a single biasing spring.

The joystick-centering device of the present invention includes a support fixture which supports the joystick. The support fixture includes a mounting bracket which supports the joystick above the base of the fixture. A restoring plate is attached to a lower end of an elongate member that comprises the joystick itself, and the restoring plate is pivotally mounted to the mounting bracket. The self-centering joystick mechanism of the present invention may be employed on a joystick rotatable about a single axis or multiple axes. In a preferred embodiment the restoring plate is mounted within a two axis gimbal which allows the joystick to be rotated independently about two perpendicular axes.

A lower surface of the restoring plate is formed of a plurality of adjacent planar segments or facets. Included among the plurality of facets are a center facet and angularly displaced lateral facets abutting the center facet. The junction between the lateral facets and the center facet form distinct straight primary contact lines between the adjacent facets. The center facet is positioned such that pairs of primary contact lines are laterally offset an equal distance from each axis. Secondary lateral facets are formed adjacent the lateral facets. The secondary lateral facets abut the lateral facets to form secondary contact lines. The secondary contact lines are offset further from their associated axes than are the parallel primary contact lines.

A force plate is disposed between the base of the fixture and the restoring plate. A compression spring is compressed between the base and the force plate to bias the force plate against the multi-faceted lower surface of the restoring plate. The compressed spring provides a restoring force which biases the force plate against the restoring plate. When the joystick is in the center position, the center facet abuts the surface of the force plate, parallel thereto. The centering force applied by the force plate is evenly distributed against the center facet such that no net torque is transmitted to the joystick. However, when the joystick is displaced by a relatively small angle about a first axis, the centering force is concentrated against only one of the primary contact lines surrounding the center position facet. When the joystick is displaced further, the centering force is applied against one of the secondary contact lines. Because the secondary contact lines are located further from the first axis than are the primary contact lines, a first relatively smaller centering torque is developed when the centering force acts against one of the primary contact lines, and a second relatively larger centering torque is developed when the centering force is acting against one of the said secondary contact lines.

The arrangement of the lateral and secondary facets, and the subsequent formation of primary and secondary contact lines, may be repeated for each axis of rotation of the joystick. Thus, multiple compound torque profiles may be provided for centering the joystick about each axis. Furthermore, such multiple compound force profiles are provided by a single biasing spring compressed between the support fixture base and the force plate, providing a significantly less complex multi-axis self centering joystick than has heretofore been available in the art.

DETAILED DESCRIPTION OF THE PREFERRED EMBODIMENT

Figure 1:
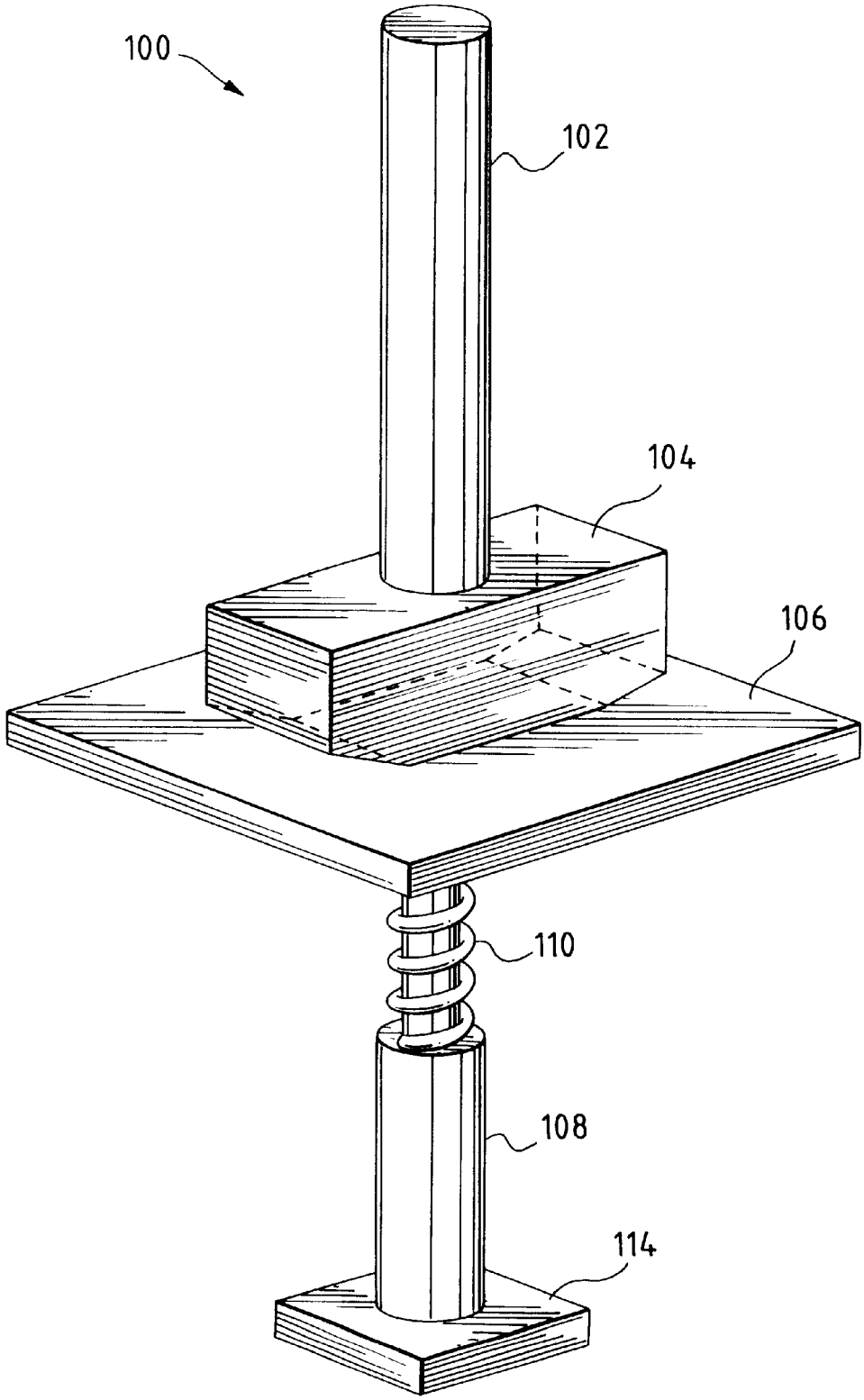
FIG. 1 is a perspective view of a self centering joystick having compound torque profiles according to a preferred embodiment of the invention.
Figure 2:
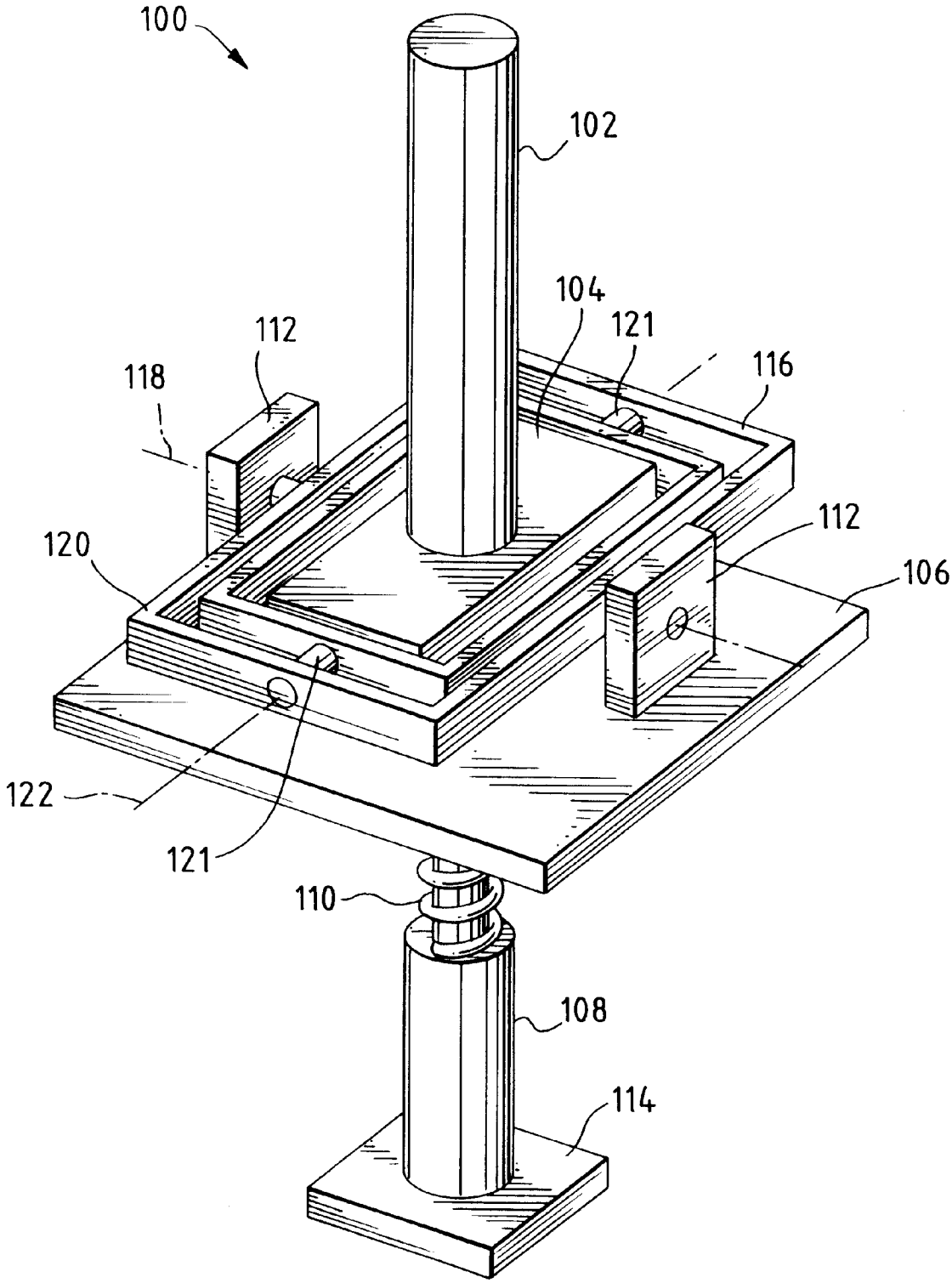
FIG. 2 is a perspective view of the self centering joystick of FIG. 1 shown mounted in a two axis gimbal.

Referring to FIGS. 1 and 2, a joystick centering device according to the preferred embodiment is shown at 100. The device acts to return an elongate member joystick) 102 to a center position after the joystick has been angularly displaced therefrom. The centering device includes a restoring plate 104 rigidly attached to the base of the joystick.

Angular displacement of the joystick is translated to rotation of the restoring plate and vice-versa. A spring loaded force plate 106 is disposed below the restoring plate. The force plate is guided by a linear bearing 108 disposed between the force plate and the base 114 of a support fixture configured to support the joystick and centering device. A coil spring 110 is compressed between the force plate and support fixture base 114, biasing the force plate against a lower surface of the restoring plate.

FIG. 2 shows the joystick centering device mounted in a two axis gimbal. The two axis gimbal allows the restoring plate and the joystick to rotate simultaneously about two perpendicular axes. The support fixture includes a pair of mounting brackets 112 which are spaced apart from the fixture's base 114. The outer gimbal 116 is pivotally mounted to the mounting brackets 112 such that the outer gimbal is free to rotate about the x-axis 118. The inner gimbal 120 is pivotally mounted within the outer gimbal 116 at inner mounts 121 so that the inner gimbal is free to rotate about a y-axis 122 which is perpendicular the x-axis 118. Restoring plate 104 is fixed within the inner gimbal 120 so that the restoring plate may be rotated about both the x-axis and y-axis. Thus, by a combination of rotation about both the x-axis and the y-axis, the joystick 102 attached to the restoring plate may be angularly displaced in any direction.

It should be noted that the two axis gimbal just described merely represents a bearing system for a self centering joystick. The present invention should not be considered limited to joysticks employing a two axis gimbal support bearing. Any support system capable of allowing an elongate member to be angularly displaced relative to a fixed mounting bracket may be employed in place of the two axis gimbal just described. Further, the present invention should not be limited to only two axis joysticks. For example, the self centering function of the present invention my be practiced on a joystick that pivots about a single axis only, or one that pivots about more than two axes.

Figure 3:
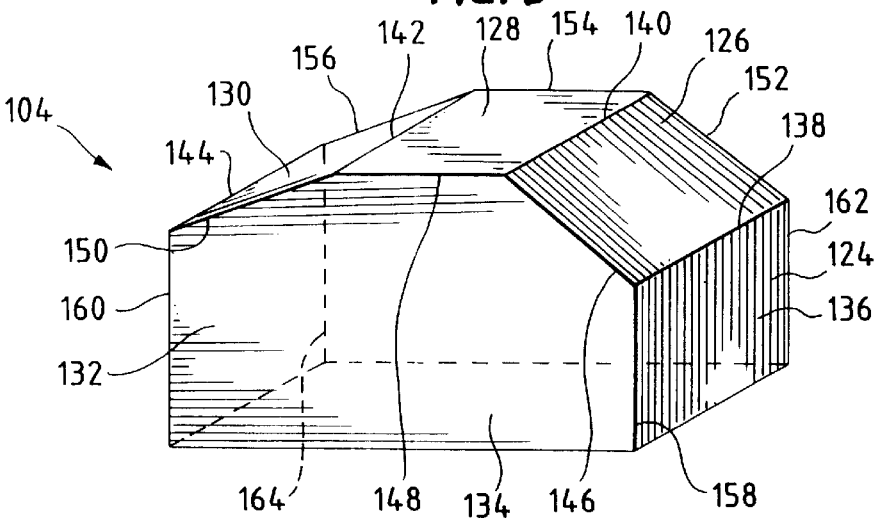
FIG. 3 is a perspective view of restoring plate.

Turning to FIG. 3, the underside of the restoring plate 104 is shown. The underside of the restoring plate forms a cam-like surface comprised of a plurality of adjacent planar segments, or facets. In the preferred embodiment, the multi-faceted surface includes a total of seven facets including a center position facet 128, lateral facets 126, 130, 134 and 136, and secondary lateral facets 124, 132. Adjacent facets intersect along sharp, well defined contact lines between each angled surface. In the preferred embodiment there are a total of ten contact lines labeled 138–156 (even numbers only) in FIG. 3. The vertical lines 158, 160, 162, and 164 forming the four comers of the restoring plate 104 may also be considered contact lines if the joystick is allowed to pivot to such an extent that facets 124 and 134 are allowed to contact the force plate 106. As will be described in more detail below, contact lines 138, 140, 142, and 144 affect the rotation of the force plate 104 about the x-axis 118, and contact lines 146, 148, 150, and 152, 154, 156 affect rotation about the y-axis. The comers 158, 160, 162, and 164 will also affect the rotation of the restoring plate 104 about the y-axis, if the joystick is allowed to rotate sufficiently to allow the comers to contact the force plate.

Figure 4:
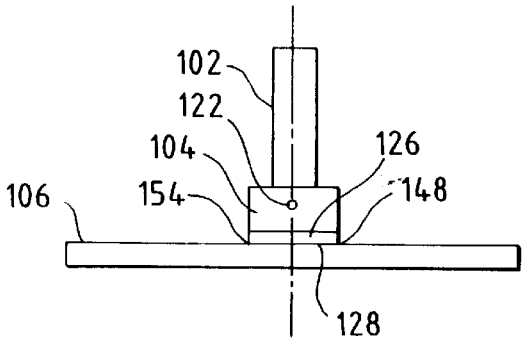
FIG. 4 is a plan view of the self centering joystick of FIG. 1 shown in the centered position looking down the y-axis.
Figure 6:
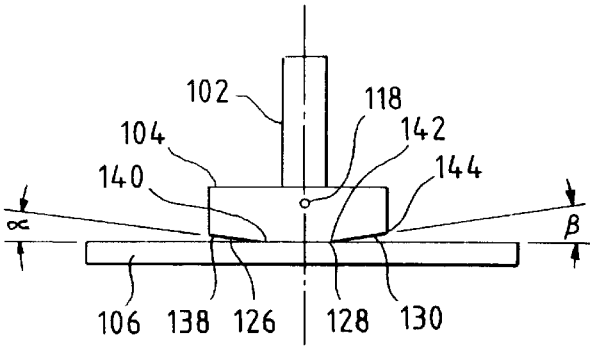
FIG. 6 is a plan view of the self centering joystick of FIG. 1 shown in the centered position looking down the x-axis.

Facet 128, located in the center of restoring plate 104, defines the center position of the joystick. FIGS. 4 and 6 show the joystick in the centered position with facet 128 abutting the surface of force plate 106. FIG. 4 is a plan view looking down the y-axis 122, and FIG. 6 is a plan view looking down the x-axis. In FIG. 4 primary contact lines 148, 154 frame the left and right edges of facet 128. Each contact line 148, 154 is laterally offset an equal distance from the y-axis 122. Force plate 106 is biased against the restoring plate by compressed coil spring 110 (FIGS. 1 & 2), which generates a centering force acting against the lower surface of the restoring plate. With the joystick in the centered position, the centering force acts against the center position facet 128 uniformly on each side of the y-axis, and the net torque developed about the y-axis is approximately zero. Due to the absence of applied torque, the restoring plate will tend to remain in the centered position relative to the y-axis.

Referring to FIG. 6, the center position relative to the x-axis is determined in the same manner. Contact lines 140, 142 frame the left and right edges of facet 128, and are laterally offset an equal distance from the x-axis 118. The restoring force exerted by force plate 106 acts uniformly against facet 128 on each side of the x-axis. Thus, no torque is developed tending to rotate the restoring plate about the x-axis. Again, as with the y-axis center position, the restoring plate will tend to remain in the center position relative to the x-axis until an external displacement force is applied to the elongate member 102.

In contrast to the centered position, when the restoring plate is angularly displaced with regard to either the x-axis or the y-axis, the restoring force exerted by force plate 106 is concentrated along lines or at points that are laterally offset from one or both of the x and y axes. This generates a restoring torque which tends to return the restoring plate to the center position. Thus, when the joystick is displaced by an external force, the restoring torque tends to re-center the device as soon as the external force is removed. Conversely, the joystick tends to remain stable in the centered position until an external force is applied.

Figure 5:
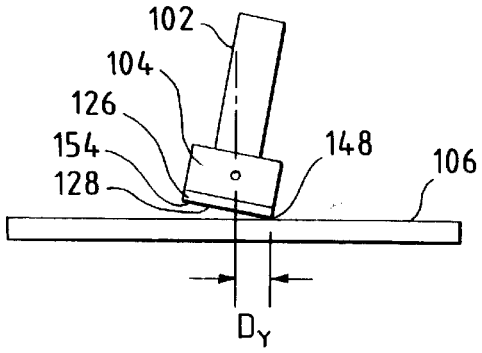
FIG. 5 is a plan view similar to FIG. 3, but with the joystick displaced relative to the y-axis.

Angular displacement of the restoring plate 104 relative to the y-axis is depicted in FIG. 5. Contact line 148, here shown in end view, forces the force plate 106 downward, further compressing spring 110. As is clear from the drawing, the points along contact line 148 represent the only points of contact between the force plate 106 and the restoring plate 104 relative to the y-axis. Therefore, the restoring force exerted by force plate 106 acts exclusively against contact line 148 which is offset from the y-axis. Thus, a restoring torque is developed which tends to rotate the restoring plate (and therefore elongate member 102) back toward the center position. The magnitude of the torque will be equal to the spring force exerted against the force plate 106 multiplied by the distance $D_y$. $D_y$ equals the horizontal distance from the y-axis to the contact line 148. As the angular displacement of the restoring plate changes, the distance $D_y$ will also change, as contact line 148 is rotated closer to vertical alignment with the y-axis. However, if the displacement of the joystick is restricted to a small angle, for example, between 5° to 10°, the distance $D_y$ will not change significantly, and the restoring torque will vary approximately proportionately with the displacement of the force plate.

Figure 9:
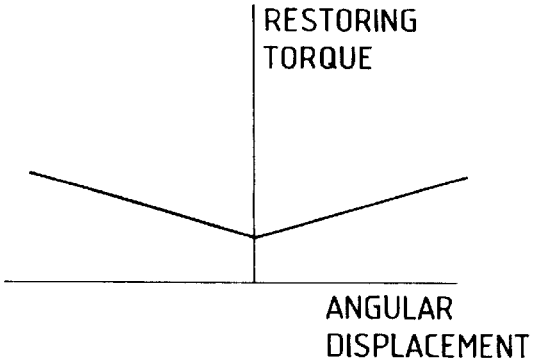
FIG. 9 is a torque profile for the self centering joystick of FIG. 1 about the y-axis.

The torque profile for rotation of the restoring plate about the y-axis is shown in FIG. 9. As can be seen, the torque increases in a substantially linear manner as the angle of displacement increases. This corresponds to the linear increase in the spring force as the coil spring 110 is further compressed by the downward rotation of contact line 148 shown in FIG. 5. Because contact line 154 is located on the opposite side of the y-axis the same distance away as contact line 148, the torque profile appears the same when the restoring plate is rotated in the opposite direction. A steeper or shallower torque profile may be provided by altering the width of the restoring plate, thereby altering the perpendicular distance $D_y$ from the y-axis to the contact lines 146, 154.

Contact lines 146 and 150, as well as comers 158 and 160 form parallel extensions of contact line 148. Similarly contacts lines 152 and 156 and comers 162 and 164 form parallel extensions of contact line 154. When viewed from the side (FIGS. 6, 7, and 8) these contact lines extend at various angles relative to contact lines 148, 154, however, when viewed from the end, as in FIGS. 4 and 5, these additional contact lines extend parallel to the contact lines 148, 154, at the same lateral distance from the y-axis. These additional contact lines and comers only have an affect when the restoring plate is simultaneously displaced relative to the x-axis and the y-axis. For example, when the restoring plate has been rotated about the x-axis so that facet 126 is parallel with the force plate 106 as shown in FIG. 8, contact lines 146 and 152 will be adjacent the force plate. Although the restoring plate has been rotated about the x-axis, there has been no displacement relative to the y-axis. The force plate continues to act uniformly against facet 126 on each side of the y-axis, and no restoring torque is generated about the y-axis. If however, the joystick is rotated with respect to the y-axis as well as with respect to the x-axis, contact line 146, or 152 will be rotated against the force plate 104 in the same manner as contact lines 148, 158 when the restoring plate was centered relative to the x-axis. The same holds true for contact lines 150 and 156 if the restoring plate is rotated about the x-axis in the opposite direction. Comers 158, 162, and 160, 164, will act in a similar capacity depending on how far the restoring plate is pivoted about the x-axis. Because each of the contact lines and comers, 158, 146, 148, 150, 160, and 162, 152, 154, 156, 164 are all located the same distance from the y-axis, and are parallel thereto, the torque profile about the y-axis shown in FIG. 9 will be that same regardless of which contact line the force plate is actually acting against.

Turning now to FIGS. 3, 6–8, and 10, rotation of the restoring plate about the x-axis will now be described. In the centered position shown in FIG. 6, the center facet 128 lies parallel to the surface of force plate 106. Both contact lines 140 and 142 (shown in end view in FIGS. 6–8) lie parallel to the surface of force plate 106. In this position, the force applied by the force plate against the restoring plate is evenly distributed on each side of the x-axis. Therefore, no torque is developed tending to rotate the restoring plate about the x-axis. Thus, the joystick tends to remain centered with respect to the x-axis.

Figure 7:
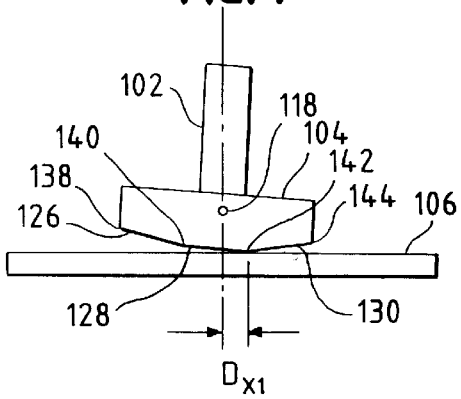
FIG. 7 is a plan view similar to FIG. 5, but with the joystick displaced relative to the x-axis by an amount less than the angle β.
Figure 8:
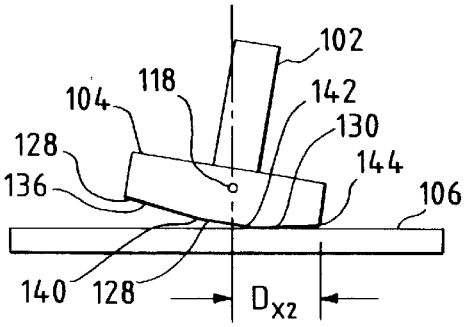
FIG. 8 is a plan view similar to FIG. 6, but with the joystick displaced relative to the x-axis by an amount equal to the angle β.

In FIG. 7, the joystick is displaced a small distance to the right, causing the restoring plate to rotate a small amount in the clockwise direction. Contact line 140 is rotated away from the force plate 106, and contact line 142 is rotated into the force plate, further compressing the spring 112. Contact line 142 is offset from the x-axis by a lateral distance $D_{x1}$. Thus, rotation of the restoring plate about the x-axis generates a restoring torque equal to the spring force applied to against contact line 142, multiplied by the distance $D_{x1}$. As with rotation about the y-axis, the distance $D_{x1}$ will vary little during the course of the limited angular displacement of the joystick envisioned in the preferred embodiment of the invention. Therefore, the restoring torque for all practical purposes will be proportional to the linear displacement of the force plate due to the downward rotation of contact line 142. Rotation of the of the restoring plate 104 in the opposite direction of that shown in FIG. 7 will have the same effect, only the force plate will act against contact line 140 and the restoring torque will be directed in the opposite direction.

When either of the contact lines 140, 142 are engaging the force plate 106, the torque profile for the x-axis will look very similar to the torque profile for the y-axis shown in FIG. 9. However, as can be seen best in FIG. 6, the facets 126 and 130 form angles $\alpha$ and $\beta$ on each side of the center facet 128. When the joystick is displaced further such that the restoring plate is rotated an amount greater than $\alpha$ or $\beta$, the primary contact lines 140 or 142 are rotated away from the surface of the force plate, and one of the secondary contact lines 138 or 144 engage the force plate. The secondary contact lines 138, 144 are located further from the x-axis and therefore the restoring torque tending to rotate the restoring plate back to the center position will be increased when the force plate engages the secondary contact lines 138, 140. This can be seen in FIG. 8. In FIG. 8, the joystick has been displaced to the right by an amount causing the restoring plate to rotate in the clockwise direction by an amount equal to the angle β. Thus, facet 130 lies parallel to the surface of the restoring plate 106. If the joystick is rotated further to the right, contact line 142 will be rotated clear of the surface of the force plate 106, and contact line 144 will rotate against the force plate, further compressing the coil spring 112. Contact line 144 is located a distance from the x-axis equal to $D_{x2}$ which is greater than $D_{x1}$. When the secondary contact line 144 engages the force plate 106, the force applied against the restoring plate is offset further from the x-axis, and the restoring torque is increased proportionally.

Figure 10:
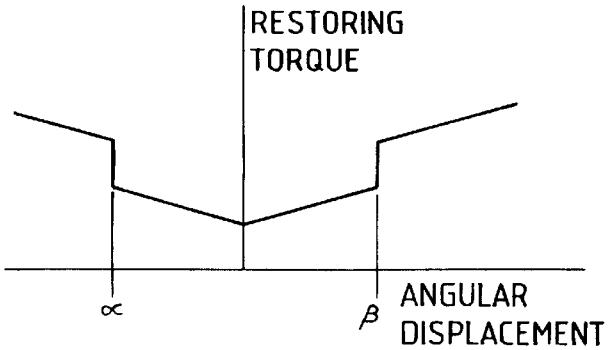
FIG. 10 is a torque profile for the self centering joystick of FIG. 1 about the x-axis.

The compound nature of the torque profile relative to the x-axis may be seen graphically in FIG. 10. When the angular displacement of the restoring plate is less than α or β, the restoring torque increases in a substantially linear manner with increasing angular displacement as in FIG. 9. However, when the angular displacement exceeds α or β, the restoring torque jumps to a higher level as the more distant secondary contact lines engage the force plate. Once the angular displacement exceeds α or β, the restoring torque again increases linearly with further angular displacement of the restoring plate.

FIG. 10 represents a compound force profile. With the present invention, such compound force profiles may be created in any direction by altering the lower surface of the restoring plate. For example, the angular position where the restoring torque jumps to a higher level may be manipulated by altering the angles α and β. Further, the size of the jump may be controlled by carefully selecting the width of the lateral facets. With the restoring plate profile shown in FIGS. 6, 7, and 8, as the width of lateral facets 126 and 130, is increased, the distance $D_{x2}$ between the primary contact lines 140, 142 and the secondary contact lines 138, 144 will increase. Thus, the greater the width of the lateral facets 126, 130, the greater will be the increase in the restoring torque at angles greater than α or β. The present invention thereby provides a self centering joystick capable of having multiple complex compound force profiles.

It should be noted that various changes and modifications to the present invention may be made by those of ordinary skill in the art without departing from the spirit and scope of the present invention which is set out in more particular detail in the appended claims. Furthermore, those of ordinary skill in the art will appreciate that the foregoing description is by way of example only, and is not intended to be limiting of the invention as described in such appended claims.

What is claimed is:

1. An apparatus for returning an angularly displaceable elongate member to a center position comprising:

a base and a mounting bracket located a fixed distance from said base, said mounting bracket defining a first axis;

a restoring plate having an upper surface and a multi-faceted lower surface pivotally mounted to said mounting bracket about said first axis, said elongate member extending from said upper surface;

a linearly displaceable force plate having a substantially flat upper surface disposed between said base and said multifaceted lower surface of said restoring plate;

a spring biasing said force plate against said multi-faceted lower surface of said restoring plate to creating a restoring force acting against said multi-faceted lower surface of said restoring plate;

said multi-faceted lower surface of said restoring plate including a center position facet symmetrically located relative to said first axis, said center position comprising an angular position of said restoring plate wherein said center position facet abuts said upper surface of said force plate and said restoring force is evenly distributed on opposite sides of said first axis.

2. The apparatus of claim 1 further comprising a second mounting bracket defining a second axis, said restoring plate and said displaceable member being pivotally mounted to said second mounting bracket about a second axis, said centering force being evenly distributed about said second axis when said center position facet abuts the upper surface of said force plate.

3. The apparatus of claim 1 further comprising a first lateral facet adjacent said center position facet and forming a first angle therewith, said first lateral facet intersecting said center position facet along a first contact line extending substantially parallel to said first axis.

4. The apparatus of claim 3 further comprising a first secondary lateral facet adjacent said first lateral facet and forming a second angle therewith, said first secondary lateral facet intersecting said first lateral facet along a second contact line extending substantially parallel to said first axis.

5. The apparatus of claim 4 further comprising a second lateral facet adjacent said center position facet and forming a third angle therewith, said second lateral facet intersecting said center position facet along a third contact line extending substantially parallel to said first axis.

6. The self centering, angularly displaceable member of claim 5 further comprising a second secondary lateral facet adjacent said second lateral facet and forming a fourth angle therewith, said second secondary lateral facet intersecting said second lateral facet along a fourth contact line extending substantially parallel to said first axis.

7. The apparatus of claim 6 further comprising a second mounting bracket located a fixed distance from said base and defining a second axis, said restoring plate being pivotally mounted to said second mounting bracket to pivot about said second axis as well said first axis, said center position facet being symmetrically located relative to said second axis such that when said restoring plate is in said center position said restoring force is evenly distributed on opposite sides of said second axis, and a third lateral facet adjacent said center position facet and forming a fifth angle therewith, said third lateral facet intersecting said center position facet along a fifth contact line extending substantially parallel to said second.

8. The apparatus of claim 7 further comprising, a fourth lateral facet adjacent said center position facet and forming a sixth angle therewith, said fourth lateral facet intersecting said center position facet along a sixth contact line extending substantially parallel to said second axis.

9. A self-centering joystick input device comprising:

a support fixture including a base and an axial support mounting located a fixed distance from said base;

a restoring plate having first and second sides, said restoring plate pivotally mounted to said axial support mounting along a first axis;

an elongate member extending from said restoring plate first side, and a multi-faceted surface formed on said second side including a center position facet and a first lateral facet angularly abutting said center position facet along a first contact line that extends generally parallel to said first axis;

a force plate disposed between said multi-faceted surface and said base; and a compression spring compressed between said base and said force plate, said spring biasing said force plate against said multi-faceted surface to provide a centering force against said first contact line when said elongate member is angularly displaced in a first direction about said first axis.

10. The self-centering joystick input device of claim 9 further comprising a second axial mount located apart from said base, said restoring plate being mounted to said second axial mount as well as said first axial mount to pivot about a second axis, said multi-faceted surface comprising a second lateral facet angularly abutting said center position facet along a second contact line that extends generally parallel to said second axis, said force plate providing a centering force acting against said second contact line when said elongate member is angularly displaced in a first direction about said second axis.

11. The self-centering joystick input device of claim 10 wherein said first axial support mounting comprises a first gimbal, pivotable about said first axis, and said second axial mount comprises a second gimbal pivotally mounted to said first gimbal.

12. The self-centering joystick input device of claim 9 further comprising a first secondary lateral facet angularly abutting said first lateral facet along a second contact line extending generally parallel to said first axis, said force plate providing a centering force acting against said second contact line when said elongate member is angularly displaced in said first direction by an angular amount exceeding the angular difference between said center position facet and said first lateral facet.

13. The self-centering joystick input device of claim 12 further comprising a second lateral facet angularly abutting said center position facet along a third contact line extending generally parallel to said first axis, said force plate providing a centering force against said third contact line when said elongate member is angularly displaced in a second direction.

14. The self-centering joystick input device of claim 13 further comprising a second secondary lateral facet angularly abutting said second lateral facet along a fourth contact line extending generally parallel to said first axis, said force plate providing a centering force against said fourth contact line when said elongate member is angularly displaced in said second direction by an angular amount exceeding the angular difference between said center position facet and said second lateral facet.

15. The self-centering joystick input device of claim 14 wherein said axial support mounting comprises a first gimbal rotatable about said first axis.

16. The self-centering joystick input device of claim 15 further comprising a second gimbal pivotally mounted to said first gimbal, thereby forming a second rotational axis, said restoring plate being attached to said second gimbal to rotate about both said first and second axes.

17. The self-centering joystick input device of claim 16 further comprising a third lateral facet angularly abutting said center position facet along a fifth contact line extending generally parallel to said second axis, said force plate providing a centering force acting against said fifth contact line when said elongate member is angularly displaced in a first direction relative to said second axis, and a fourth lateral facet angularly abutting said center position facet along a sixth contact line extending generally parallel to said second axis, said force plate providing a centering force acting against said sixth contact line when said elongate member is angularly displaced in a second direction relative to said second axis.

18. The self-centering joystick input device of claim 17 further comprising seventh and eighth contact lines extending parallel to the second axis, said third facet abutting said first lateral facet along said seventh contact line, and said second lateral facet along said eighth contact line, and ninth and tenth contact lines extending parallel to said second axis, said forth facet abutting said first lateral facet along said ninth contact line, and said second lateral facet along said tenth contact line.

19. A joystick centering device providing compound force profiles for restoring said joystick to a centered position after said joystick has been displaced therefrom, said joystick centering device comprising:

a support fixture including a base and a mounting bracket located away from said base;

a restoring surface associated with said joystick pivotally mounted to said mounting bracket so that said joystick is partially rotatable about a first axis, said restoring surface comprising a plurality of adjacent planar segments, including a center segment and angularly displaced lateral segments adjacent said center segment, said lateral segments abutting said center segment to form primary contact lines therebetween, said primary contact lines being laterally offset from said first axis, said restoring surface further comprising secondary lateral surfaces angulary displaced from said lateral surfaces, said secondary lateral segments abutting said lateral segments to form secondary contact lines, said secondary contact lines being laterally offset from said axis by an amount greater than said primary contact lines;

a force plate disposed between said restoring surface and said support fixture base; and a spring compressed between said base and said force plate biasing said force plate against said restoring surface to providing a centering force, said centering force being evenly distributed against said center segment when said joystick is in the centered position such that a net torque about said axis is negligible when said joystick is centered, said centering force being concentrated against one of said primary contact lines when said joystick is displaced by a relatively small angle about said axis, and against a secondary contact line when displaced by a larger angle, thereby creating a first centering torque when said centering force acts against said primary contact lines, and a second larger centering torque is developed when said centering force acts against said secondary contact lines.

20. The joystick centering device of claim 19 wherein said mounting bracket comprises a two axis gimbal allowing said joystick to be angularly displaced relative to two axes.

21. The joystick centering device of claim 20 further comprising a linear bearing disposed between said base and said force plate to maintain said centering force perpendicular to said restoring plate.

* * * * *